US010876316B2

(12) United States Patent
Hui et al.

(10) Patent No.: US 10,876,316 B2
(45) Date of Patent: Dec. 29, 2020

(54) PORTABLE POOL CLEANER AND METHOD THEREFOR

(71) Applicants: Wing-Tak Hui, Hong Kong (CN); Andrew Matthew Hui, San Jose, CA (US); Martin Wing-Kin Hui, Hong Kong (CN)

(72) Inventors: Wing-Tak Hui, Hong Kong (CN); Andrew Matthew Hui, San Jose, CA (US); Martin Wing-Kin Hui, Hong Kong (CN)

(73) Assignee: Wing-Kin Martin Hui, Hong Kong (CN)

( * ) Notice: Subject to any disclaimer, the term of this patent is extended or adjusted under 35 U.S.C. 154(b) by 464 days.

(21) Appl. No.: 15/065,519

(22) Filed: Mar. 9, 2016

(65) Prior Publication Data

US 2017/0260766 A1 Sep. 14, 2017

(51) Int. Cl.

| | |
|---|---|
| ***E04H 4/16*** | (2006.01) |
| ***A47L 9/30*** | (2006.01) |
| ***A47L 9/14*** | (2006.01) |
| ***A47L 9/28*** | (2006.01) |

(52) U.S. Cl.

CPC ..... *E04H 4/1636* (2013.01); *A47L 9/1409* (2013.01); *A47L 9/2884* (2013.01); *A47L 9/30* (2013.01)

(58) Field of Classification Search

CPC ..... E04H 4/1636; E04H 4/1618; E04H 4/16; E04H 4/1609; A46B 15/0036; B65G 51/18; A47L 9/02

USPC ..... 15/1.7

See application file for complete search history.

(56) References Cited

U.S. PATENT DOCUMENTS

| | | | | |
|---|---|---|---|---|
| 3,868,739 | A | 3/1975 | Hargrave | |
| 5,842,243 | A * | 12/1998 | Horvath | E04H 4/1636 15/1.7 |
| 5,852,841 | A * | 12/1998 | Rissik | E04H 4/1663 15/1.7 |
| 6,454,428 | B1 * | 9/2002 | Bruzon | B25G 1/04 362/119 |
| 6,502,269 | B1 * | 1/2003 | Balchan | E04H 4/1636 15/1.7 |
| 6,797,157 | B2 | 9/2004 | Erlich | |
| 6,939,460 | B2 | 9/2005 | Erlich | |
| 7,060,182 | B2 * | 6/2006 | Erlich | E04H 4/1636 134/168 R |
| 7,636,975 | B2 | 12/2009 | Mah | |
| 8,281,441 | B1 | 10/2012 | Erlich | |

(Continued)

*Primary Examiner* — Orlando E Aviles
*Assistant Examiner* — Aaron R McConnell
(74) *Attorney, Agent, or Firm* — Weiss & Moy, P.C.; Jeffrey D. Moy

(57) ABSTRACT

A pool cleaner for cleaning a swimming pool has a vacuum head having an intake nozzle drawing in fluid. A body chamber is coupled to the intake nozzle and has an intake end and a discharge end. A pump is housed within the body chamber drawing fluid from the intake end and expelling the fluid through the discharge end. A filter is placed within the body chamber filtering out particulates from the fluid drawn into the body chamber. A battery pack is located remote from the pool cleaner and wearable by a user of the pool cleaner. A power cord couples the battery pack to the pump. The power cord being electrically connected to the pump by a waterproof connector.

20 Claims, 5 Drawing Sheets

(56) References Cited

U.S. PATENT DOCUMENTS

| | | | | |
|---|---|---|---|---|
| 9,091,092 | B1 | 7/2015 | Hui | |
| 2008/0128343 | A1* | 6/2008 | Garti | E04H 4/1654 210/167.16 |
| 2016/0326763 | A1* | 11/2016 | Bruneel | E04H 4/1672 |

* cited by examiner 155
153
142
140
154
152
138
144B 136
130
146
144
100
148
118
148A
102
101

Aux 155
153
154
140
142
138
152
148B 149
138
156
160
148C
156'
146
144
100
118
148A
158
148
148C
102
101

PORTABLE POOL CLEANER AND METHOD THEREFOR

RELATED APPLICATIONS

The present application is related to U.S. Pat. No. 9,091,092 entitled, "POOL CLEANER", filed May 21, 2014, having Ser. No. 14/284,386, filed in the name of the same inventor as the present application and incorporated herewith.

TECHNICAL FIELD

The present application generally relates to a cleaning device for a swimming pool, and more specifically, to a manual swimming pool cleaning device that has a power supply that may be worn by a user to allow for more efficient cleaning and an illumination device to help the user more clearly view the pool when cleaning.

BACKGROUND

Swimming pool cleaning devices (hereinafter pool cleaners) are used for maintaining residential and commercial swimming pools in a clean and attractive condition. Pool cleaners have been developed for cleaning and/or dislodging settled debris from the floor and side wall surfaces of the swimming pool, thereby substantially reducing the need for manual vacuuming and/or brushing of the floor and side wall surfaces of the swimming pool.

Pool cleaners generally fall into two groups; suction type, and pressure side type. The two groups of pool cleaners can be further categorized by; their means of power (i.e. the pool's filtering system or by independent power), and their means of movement (i.e. automatic or manual).

Manual type pool cleaners may be used for quick and/or spot cleaning of the swimming pool. The manual type pool cleaners may have a self-contained suction assembly. The self-contained suction assembly may use a submersible pump and battery with the filter located at the pump outlet. While manual type pool cleaners do work, most are underpowered due to the limited room for larger power supplies in the self-contained suction assembly as well the risk of damage due to water leakage into the self-contained suction assembly.

Therefore, it would be desirable to provide a system and method that overcomes the above.

SUMMARY

In accordance with one embodiment, a pool cleaner for cleaning a swimming pool is disclosed. The pool cleaner a vacuum head having an intake nozzle drawing in fluid. A body chamber is coupled to the intake nozzle and has an intake end and a discharge end. A pump is housed within the body chamber drawing fluid from the intake end and expelling the fluid through the discharge end. A filter is placed within the body chamber filtering out particulates from the fluid drawn into the body chamber. A battery pack is located remote from the pool cleaner and wearable by a user of the pool cleaner. A power cord couples the battery pack to the pump. The power cord being electrically connected to the pump by a waterproof connector.

In accordance with one embodiment, a pool cleaner for cleaning a swimming pool is disclosed. The pool cleaner has a vacuum head having an intake nozzle drawing in fluid. A body chamber is coupled to the intake nozzle and has an intake end and a discharge end, wherein fluid entering the body chamber is filtered. A battery pack is located remote from the pool cleaner and wearable by a user of the pool cleaner. A lighting element is coupled to the pool cleaner. A power cord is coupled to the battery pack. The power cord is electrically connected to a pump in the body chamber and the lighting element by waterproof connectors.

In accordance with one embodiment, a pool cleaner for cleaning a swimming pool is disclosed. The pool cleaner has a vacuum head having an intake nozzle drawing in fluid. A body chamber is coupled to the intake nozzle and has an intake end and a discharge end. A pump is housed within the body chamber drawing fluid from the intake end and expelling the fluid through the discharge end. A filter is placed within the body chamber filtering out particulates from the fluid drawn into the body chamber. A dirt tray is hingely coupled to a bottom area of the body chamber. A latching mechanism hingely secures the dirt tray to the bottom of the body chamber. A lighting element is coupled to the pool cleaner. A battery pack is located remote from the pool cleaner and wearable by a user of the pool cleaner. A power cord couples the battery pack to the pump and the lighting element. The power cord is electrically connected to the pump and the lighting element by waterproof connectors. A housing stores the battery pack. An activation/deactivation switch is formed in the housing. A first housing connector couples the power cord to the battery pack. A second housing connector couples the battery pack to an auxiliary power supply.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figures 1A, 1B, 1C:
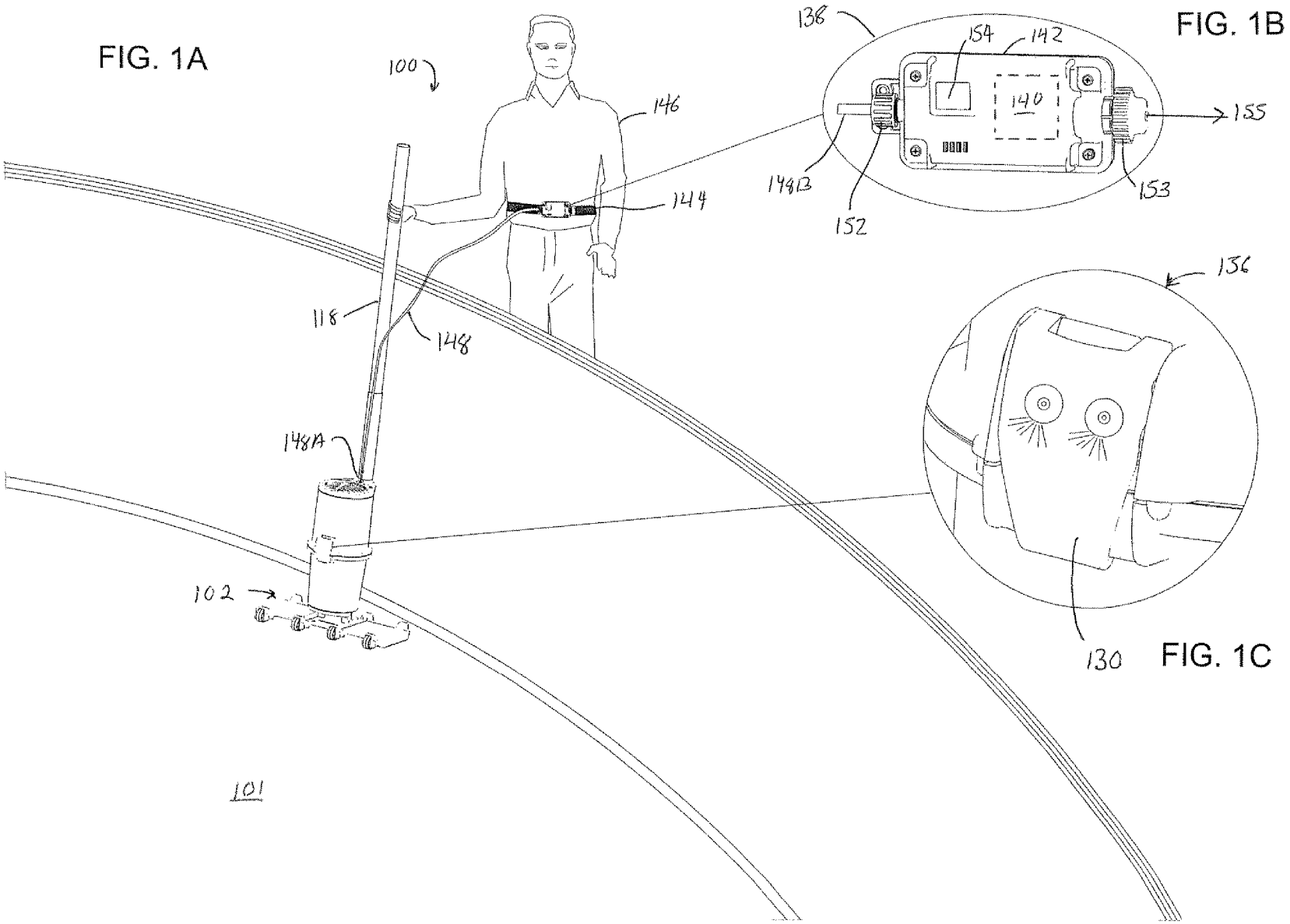
FIG. 1A is a perspective view of a portable pool cleaner, in accordance with an embodiment of the present invention.
FIG. 1B is a front view of a portable power supply used with the pool cleaner of FIG. 1A, in accordance with an embodiment of the present invention.
FIG. 1C is a perspective view of a lighting element used in the portable pool cleaner of FIG. 1A, in accordance with an embodiment of the present invention.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Embodiments of the exemplary system and method disclose a portable pool cleaner. The portable pool cleaner may have a power supply located remotely from the portable pool cleaner. The power supply may be worn by a user to allow for more efficient cleaning of the swimming pool. The wearable power supply may eliminate the need for external carts which may be associated with portable pool cleaner and the difficulty and inconvenience in moving the external carts when cleaning the swimming pool. The portable pool cleaner may have an illumination device to help the user more clearly view the pool when cleaning.

Referring to FIGS. 1-5, a pool cleaner 100 is shown. The pool cleaner 100 may be a portable cleaner that may be used to remove debris and filter water from a swimming pool 101 or other bodies or water. The pool cleaner 100 may be submerged and operated under water. When the pool cleaner 100 is activated, the pump within pool cleaner 100 starts. Water inside a body housing the pump may be pushed out through a discharge opening of the body, creating a vacuum within the body. The vacuum may cause water from the pool to flow into the body through an intake opening. The water may then be pushed out of the body by the pump. A filter mechanism within the body may block debris in the water from passing through as the water flows in and out of the body, thereby filtering the water. The pool cleaner 100 may be portable and is light enough and small enough that pool cleaner 100 may be carried from place to place by a single individual.

The pool cleaner 100 may have a vacuum head 102. The vacuum head 102 may have an intake nozzle 106 that may control the intake of water into pool cleaner 100. A base plate 104 may extend around the intake nozzle 106. The base plate 104 may be a flat surface that gives the pool cleaner 100 the stability to stand upright when placed on the ground. In another embodiment, vacuum head 102 may be the intake nozzle 106 without a base plate 104. In some embodiments, vacuum head 102 may be out of a rigid or semi-rigid material.

Bristles 108 may be coupled to a bottom area of the base plate 104. The bristles 108 may be stiff hair-like structures. The bristles 108 may be made from synthetic or natural material. In accordance with one embodiment, the bristles 108 may form rows along the bottom of the base plate 104. This may allow the user 146 to effectively scrub the surfaces of the swimming pool 101 with the pool cleaner 100, loosening dirt on the bottom of the swimming pool 101, while filtering the pool water. The bristles 108 may be may be attached directly to the base plate 104, located in a trough that snap into wells on the base plate 104 of the vacuum head 102 or attached by other means to the base plate 104. The above is given as examples and should not be seen in a limiting manner.

A plurality of wheels 110 may be pivotally attached to a bottom area of the base plate 104. The plurality of wheels 110 may provide better mobility for pool cleaner 100 to move across the surfaces of the swimming pool 101. The wheels 110 may be placed to maintain stability of the pool clean 100.

A pivot mount 112 may be coupled to the intake, nozzle 106. The pivot mount 112 may connect the vacuum head 102 to the rest of the pool cleaner 100 in a manner that allows the vacuum head 102 to rotate, in accordance with one embodiment, the pivot mount 112 may have a sphere-shaped top portion 112A connected to a cylindrical bottom portion 112B. The pivot mount 112 may have an opening in the top portion connected by a channel to an opening in the bottom portion, creating a passage for water to flow through, in an embodiment, pivot mount 112 may be hollow. A top portion of pivot mount 112 may connect to an intake of a body chamber 120 while a bottom portion of the pivot mount 112 may connect to the intake nozzle 106 of the vacuum head 102.

The pivot mount 112 may allow the vacuum head 102 to pivot when pool cleaner 100 is in use. In accordance with one embodiment, with the pivot mount 112 connected, the vacuum head 102 may be horizontal to the pool surface while the body chamber 120 is tilted up to 45 degrees from the pool surface. A pivot cover 114 may be used to cover the pivot mount 112. The pivot cover 114 may protects the pivot and may help keep pivot mount 112 from sliding sideways.

A body chamber 120 may be coupled to the vacuum head 102. In accordance with one embodiment, the body chamber 120 may be coupled to the vacuum head 102 via the pivot mount 112. The body chamber 120 may be used to house a pump and one or more filters. While the present embodiment shows the body chamber 120 as being cylindrical in shape, this is only shown as an example. The body chamber 120 may take on other geometric shapes without departing from the spirit and scope of the present invention.

The body chamber 120 may be hollow with two open ends. One end of body chamber 120 may be the intake end, and the other open end may be the discharge end. The opening of the intake end may be larger than the opening of the discharge end. The intake end may be covered by a mesh filter while the discharge end may be covered by a discharge cover 120A. In another embodiment, the density of body chamber 120 with all of the contents (including air) and the components within body chamber 120 may be equal to or greater than water, thereby allowing the body chamber 120 to sink in water, keeping the pump immersed in water, which protects the seal from dry running in the air.

The body chamber 120 may have a body connector 120B. The body connector 116E may allow the body chamber 120 to connect with a pole member 118. The pole member 118 may allow the pool cleaner 100 to be operated in swimming pools 101 that may be wide and/or deep without the user 146 having to be in the swimming pool 101. In accordance with one embodiment, the pole member 118 may be an extendable pole member such as a telescopic pole member or similar devices. The extendable pole member may allow for the pole member 118 to be extended to different length to reach all surfaces of the swimming pool 101 without the user 146 having to be in the swimming pool.

Located within the body chamber 120 may be a pump 116. The pump 116 may be a water pump capable of moving water surrounding the pump 116. The pump 116 may draw water into the body chamber 120 and pushes water out of body chamber 120. The pump 116 may have an intake end and a discharge end. The pump 116 may have an impeller 116A. The impeller 116A may be used to move the water through the pool cleaner 100. The pump 116 may be an electromechanical pump that is powered by an electric motor using a magnetic field.

A pump cage 122 may encase the pump 116. The pump cage 122 may have a mesh configuration, preventing a filter bag 123 from touching the pump 116 when the filter bag 123 is under hydraulic pressure. In accordance with one embodiment, the pump cage 122 may be a rigid mesh. The pump cage 122 may cover the sides and intake end of the pump 116. In such embodiment, the discharge-end points away from the pump cage 122 and outward through an opening in the pump cage 122 that does not have a mesh.

A rigid mesh 124 may be a support for the filter bag 123 that fits within the body chamber 120 for maintaining the structure of the filter bag 123 while opening and closing the pool cleaner 100 and in other situations, such as when pump 116 is off. The rigid mesh 124 may be cylindrically shaped and hollow, in accordance with one embodiment, the rigid mesh 124 may be open at the top 124A and bottom 124B so as to allow fluid to flow through the rigid mesh 124. The top opening 124A may be covered by the filter bag 123. Optionally, the rigid mesh 124 may have numerous openings 124C along the sides to allow water to pass through. The rigid mesh 124 may be placed at the intake end of the body chamber 120 but still within body chamber 120. In another embodiment, the diameter of the rigid mesh 124 may be slightly less than the diameter of the body chamber 120, leaving some space between the interior walls of the body chamber 120 and the rigid mesh 124. When the pump 116 is off, the filter bag 123 may rest on the rigid mesh 124. The rigid mesh 124 may have other shapes (e.g., rectangular, ovular, triangular, or hexagonal) than those disclosed above.

The body chamber 120 may have a dirt tray 126 formed on a bottom area thereof. A latching mechanism 128 may be used to hingely secure the dirt tray 126 to the bottom of the body chamber 120. In accordance with one embodiment, a latch 130 may be mounted to the body chamber 120 via a latch mount 132. A spring 134 may be attached to the latch 130 mechanically biasing the clasp or hook portion of latch 130 to stay closed after the clasp or hook portion engages the receiving portion on dirt tray 126.

A pivot element 136 may run through a hole in dirt tray 126 and a hole in the pivot mount 112, ensuring that the pivot mount 112 may be pivotally connected to the dirt tray 126. The pivot element 136 may be a peg that engages the pivot cover 114 to hold the pivot element 136 in place. The pivot element 136 may be covered by the pivot cover 114. When assembled, the body chamber 120 may pivot on the pivot element 136 about an axis passing through the pivot element 136.

A power supply 138 may be used to power the pool cleaner 100. The power supply 138 may be one or more battery blocks 140 or the like stored within a housing 142. The battery blocks 140 may be rechargeable batteries that may be plugged into an AC outlet or an external battery to recharge. As may be seen in FIGS. 1A and 2A, the power supply 138 is detached and remote from the pool cleaner 100. The power supply 138 may be worn by a user 146. In accordance with one embodiment, a belt and/or strap 144 may be used to allow the power supply 138 to be worn by the user 146.

A power cord 148 may be used to electrically couple the power supply 138 to the pump 116. A first end 148A of the power cord 148 may be coupled to a waterproof connector 150. The waterproof connector 150 may be used to connect the power cord 148 to the pump 116. In accordance with one embodiment, the waterproof connector 150 may have Ingress Protection (IP) rating wherein the second digit of the rating is an 8 or higher (i.e., IP#8). An 8 rating mean that the equipment (i.e., the waterproof connector 150) may be suitable for continuous immersion in water under conditions which shall be specified by the manufacturer. Normally, this may mean that the equipment is hermetically sealed. However, with certain types of equipment, it can mean that water can enter but only in such a manner that it produces no harmful effects. A second end 148B of the power cord 148 may be coupled to a connector 152. The connector 152 may be used to connect the power cord 148 to the power supply 138. While the connector 152 does not need to be waterproof since it will not be submerged in the swimming pool 101, the connector 152 may have IP rating wherein the second digit of the rating is a 4 or higher (i.e., IP#4). A four rating may be effective and should have no harmful effects against water splashing against the connector 152 from any direction. However, a higher rating, such as a 7 or 8 rating may protect the user 146 should the user accidently fall in the swimming pool.

The housing 142 may have a connector 153. The connector 153 may be used to connect the housing 142 and hence the power supply 138 to an auxiliary power supply 155. The auxiliary power supply 155 may be used to charge the battery blocks 140 or alternatively, power the pool cleaner 100 if the battery blocks 140 have no energy. While the connector 153 does not need to be waterproof since it will not be submerged in the swimming pool, the connector 153 may have IP rating wherein the second digit of the rating is a 4 or higher (i.e., IP#4). A four rating may be effective and should have no harmful effects against water splashing against the connector 153 from any direction. However, a higher rating, such as a 7 or 8 rating may protect the user 146 should the user accidently fall in the swimming pool.

An activation/deactivation button 154 may be formed on the housing 142. The activation/deactivation button 154 may be used to activate and deactivate the pool cleaner 100. In general, the activation/deactivation button 154 may connect and disconnect the power supply 138 to the pump 116. While the housing 142 and the activation/deactivation button 154 do not need to be waterproof since they will not be submerged in the swimming pool, the housing 142 and the activation/deactivation button 154 may have an IP rating wherein the second digit of the rating is a 4 or higher (i.e., IP#4). A four rating may be effective and should have no harmful effects against water splashing against the housing 142 and the activation/deactivation button 154 from any direction. However, a higher rating, such as a 7 or 8 rating may protect the user 146 should the user accidently fall in the swimming pool.

A lighting device 156 may be coupled to the pool cleaner 100. The lighting device 156 may allow the user 146 to more clearly see the surfaces of the swimming pool the user 146 may be trying to clean. The lighting device 156 may be useful during times with low visibility such as during the early morning or evening time frame when there is little to no light. Thus, the lighting device 156 may extend the time the pool cleaner 100 may be used.

Figures 2A, 2B, 2C:
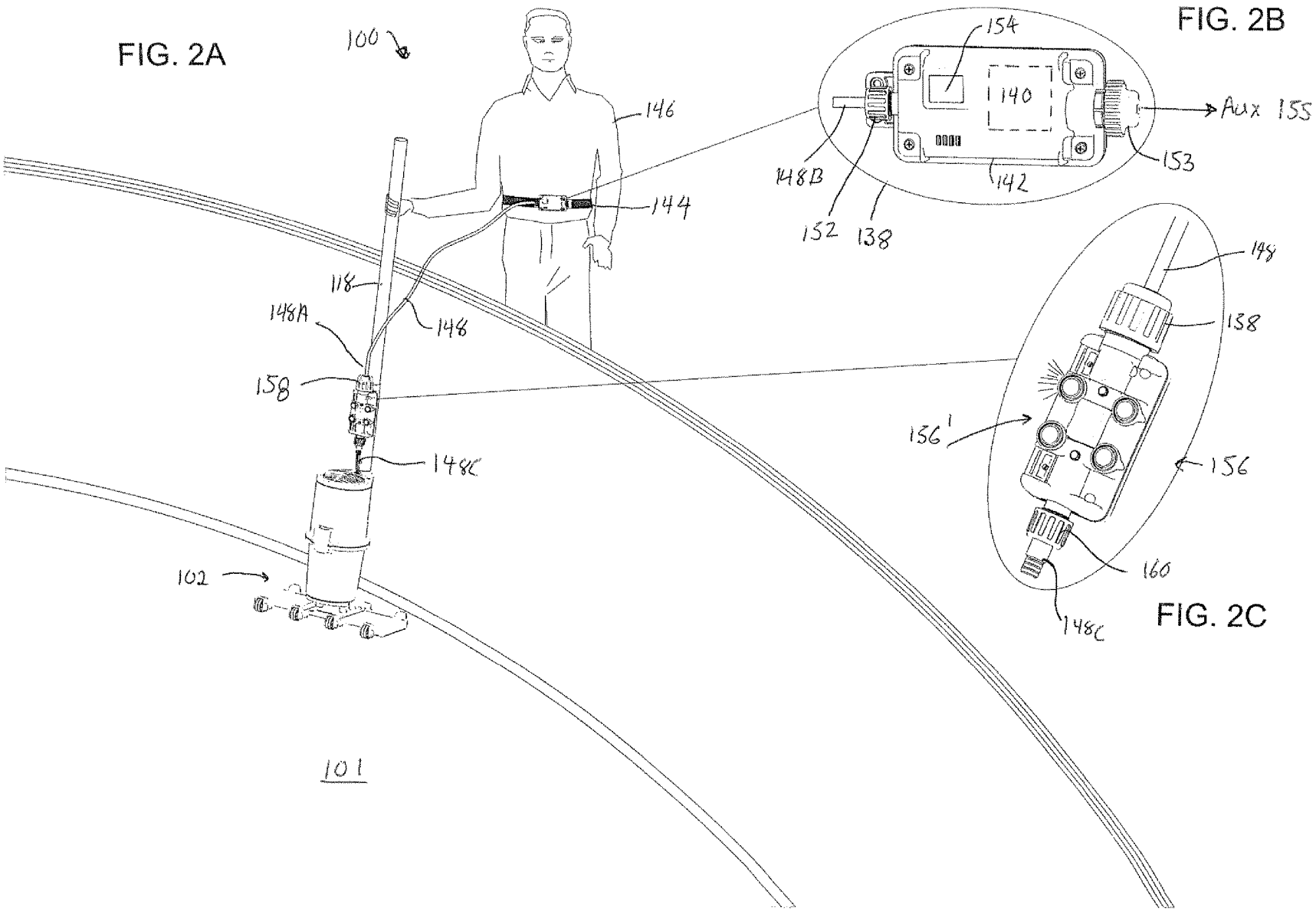
FIG. 2A is a perspective view of a portable pool cleaner, in accordance with an embodiment of the present invention.
FIG. 2B is a front view of a portable power supply used with the pool cleaner of FIG. 2A, in accordance with an embodiment of the present invention.
FIG. 2C is a perspective view of a lighting element used in the portable pool cleaner of FIG. 2A, in accordance with an embodiment of the present invention.
Figure 3:
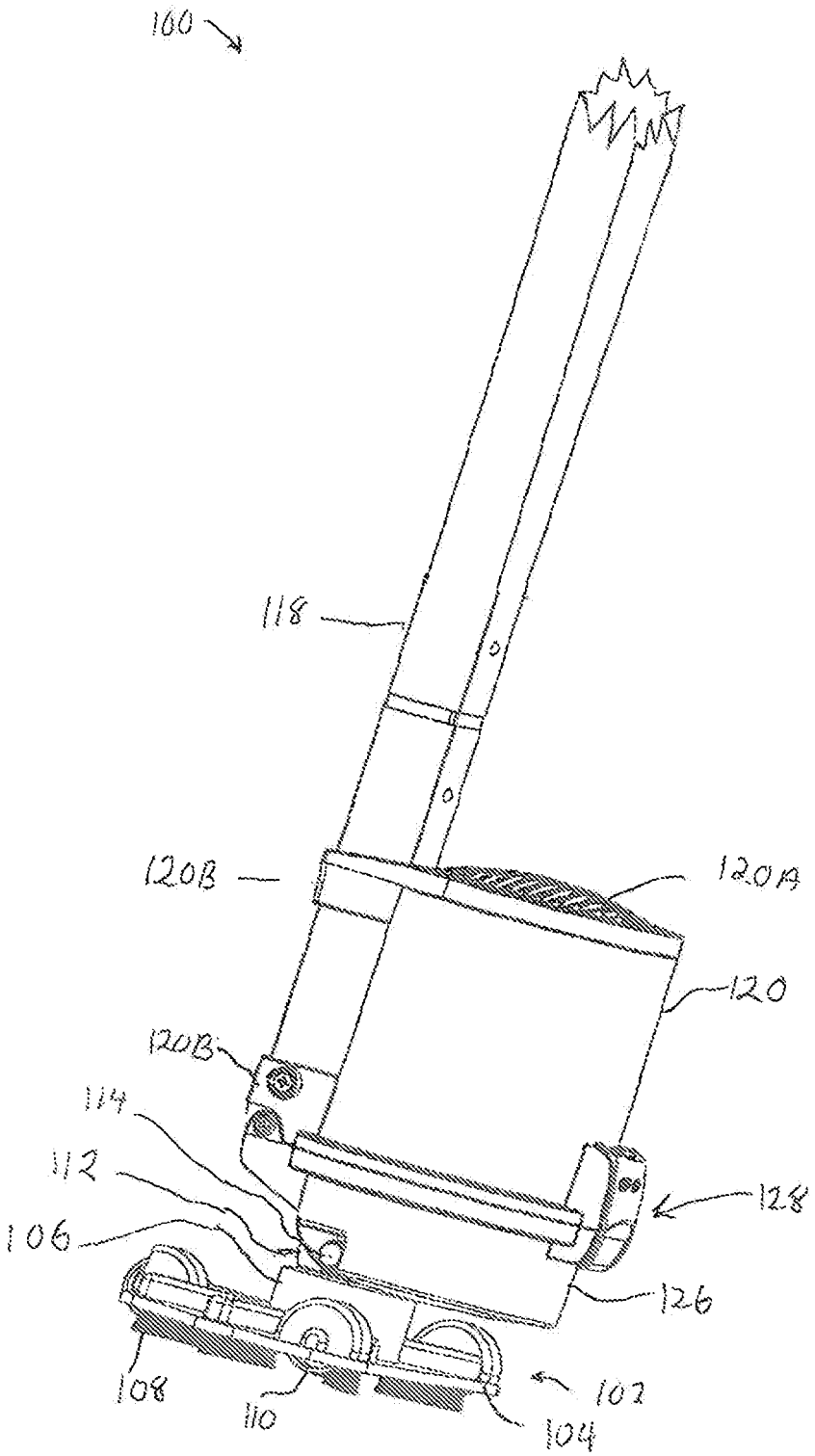
FIG. 3 is a perspective view of the pool cleaner of FIG. 1A, in accordance with an embodiment of the present invention.
Figure 4:
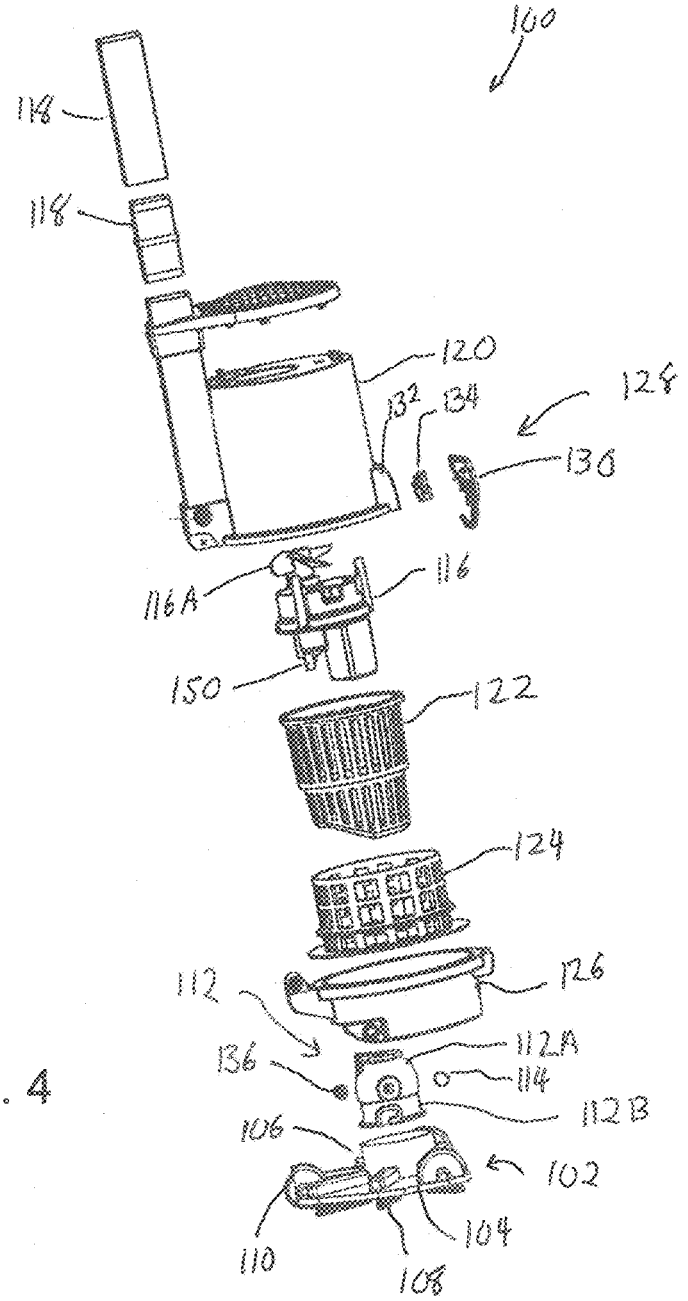
FIG. 4 is an exploded perspective of the pool cleaner of FIG. 1A, in accordance with an embodiment of the present invention.
Figure 5:
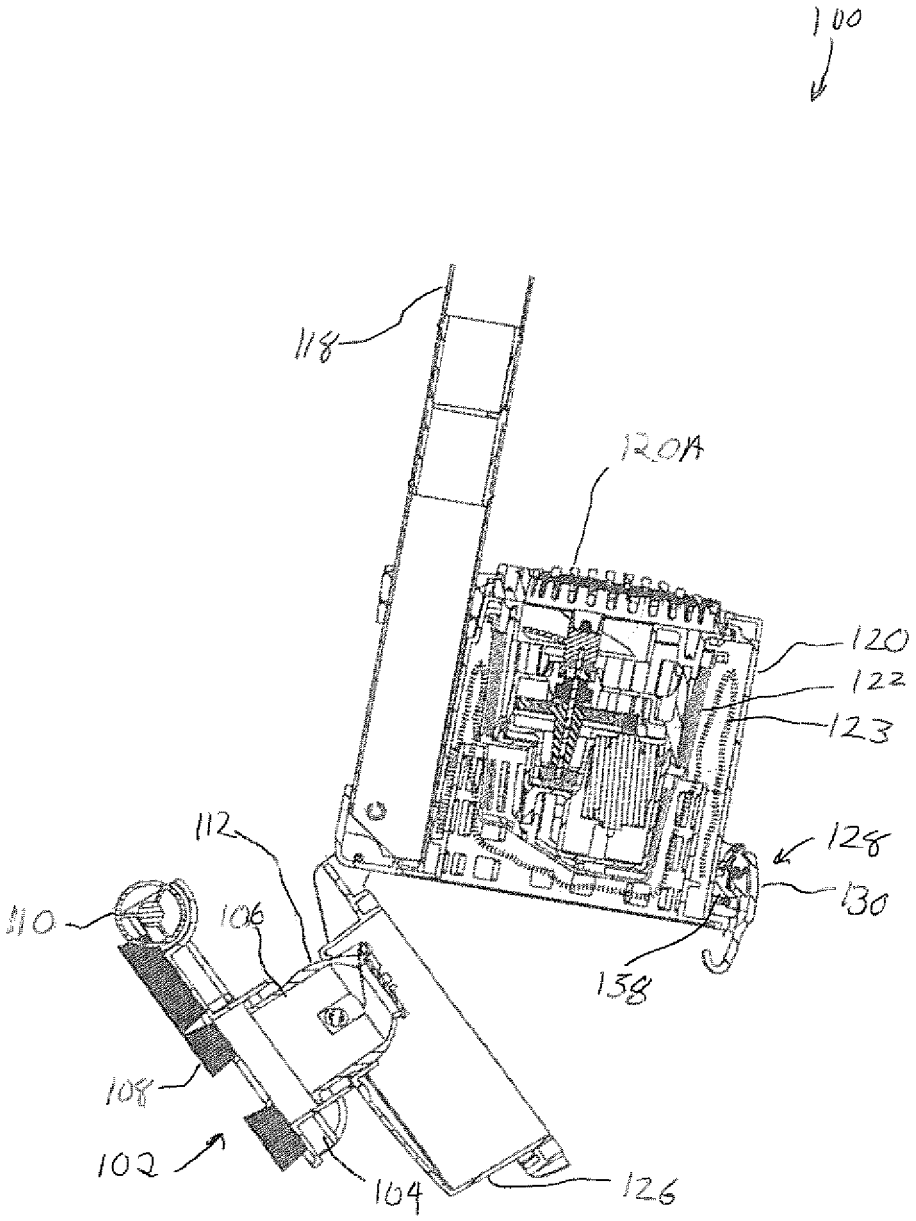
FIG. 5 is a cross-sectional view of the pool cleaner of FIG. 1A, in accordance with an embodiment of the present invention.

In accordance with one embodiment, the lighting device 156 may be attached to the body chamber 120. The lighting device 156 may be built into and form a part of the body chamber 120. As may be seen in FIGS. 1A and 1C, the lighting device 156 may be attached to and form a part of the latching mechanism 128. The lighting device 156 may be power by the power supply 138. In accordance with one embodiment, the first end 148A of the power cord 148 may be spliced and coupled to the waterproof connector 150 (FIG. 4) as well as a waterproof connector 158 (FIG. 2A). The waterproof connector 158 may couple the lighting device 156 to the power cord 148. In accordance with one embodiment, the waterproof connector 158 may have an IP rating wherein the second digit of the rating is an 8 or higher (i.e., IP#8). An 8 rating mean that the equipment (i.e., the waterproof connector 158) may be suitable for continuous immersion in water under conditions which shall be specified by the manufacturer.

Alternatively, as shown in FIGS. 2A and 2C, the lighting device 156' may be detachable. In the embodiment shown in FIG. 2, the lighting device 156' may be removably attached to different parts of the pool cleaner 100. While FIG. 2, shows the lighting device 156' attached to the pole member 118, the lighting device 156' may be removably attached to other parts of the pool cleaner 100 without departing from the spirit and scope of the present invention. The lighting device 156' may have a pair of lighting connectors 158 and 160. The lighting connector 158 may connect the power cord 148 to the lighting device 156'. The lighting connector 160 may connect the lighting device 156' to the pump 116 via a power cord 148C. In accordance with one embodiment, the lighting connectors 158 and 160 may have an IP rating wherein the second digit of the rating is an 8 or higher (i.e., IP#8). An 8 rating mean that the equipment may be suitable for continuous immersion in water under conditions which shall be specified by the manufacturer.

The foregoing description is illustrative of particular embodiments of the application, but is not meant to be a limitation upon the practice thereof. The following claims, including all equivalents thereof, are intended to define the scope of the application.

What is claimed is:

1. A pool cleaner for cleaning a swimming pool, comprising:

a vacuum head having an intake nozzle drawing in fluid;

a pivot mount attached to the intake nozzle, the pivot mount allowing the vacuum head to rotate about the pivot mount, wherein the pivot mount comprises:

a cylindrical member attached to the intake nozzle; and a spherical member rotatably attached to the cylindrical member, the spherical member in fluid communication with the cylindrical member;

a pivot cover attached to the pivot mount preventing sideways movement;

a body chamber being cylindrical in shape and coupled to the intake nozzle through the pivot mount, the body chamber having an intake end and a discharge end;

a pump housed within the body chamber drawing fluid from the intake end and expelling the fluid through the discharge end;

a pump cage having an open top area and positioned within the body chamber, wherein the pump is positioned within the pump cage, the pump cage surrounding sides and an intake end of the pump, a discharge end of the pump pointing towards the open top area and away from the pump cage;

a mesh structure having an open top, bottom and a plurality of side openings, the mesh structure having a same geometric shape as the body chamber, a diameter of the mesh structure being smaller than a diameter of the body chamber;

a filter bag placed within lining an interior of the mesh structure and surrounding the pump cage, ends of the filter bag covering the exterior of the mesh structure, the filter bag resting on the mesh structure when the pump is inactive, when the pump is active, pressure causing the filter bag drawn towards the pump cage, the pump cage preventing the filter bag from contacting the pump, the filter bag filtering out particulates from the fluid drawn into the body chamber;

a battery pack located remote from the pool cleaner and wearable by a user of the pool cleaner;

a dirt tray hingely attached to a bottom area of the body chamber, the pivot mount pivotally coupled to the dirt tray;

a latching mechanism attached to the body chamber and the dirt tray to hingely attach the dirt tray to the bottom area of the body chamber;

a discharge cover positioned over the discharge end of the body chamber;

a power cord coupling the battery pack to the pump, the power cord being electrically connected to the pump; and a pair of waterproof connectors, wherein a first waterproof connector is connected between a first end of the power cord and the pump and a second waterproof connector connected between a second end of the power cord and the battery pack.

2. The pool cleaner of claim 1, comprising a lighting element coupled to the pool cleaner.

3. The pool cleaner of claim 2, wherein the lighting element is detachable from the pool cleaner.

4. The pool cleaner of claim 3, wherein the lighting element comprises:

a first lighting element, connector attached to, the power cord; and a second lighting element connector, wherein the second lighting element connector attaches a second power cord from the lighting element to the pump.

5. The pool cleaner of claim 2, wherein the lighting element is permanently coupled to the body chamber.

6. The pool cleaner of claim 1, wherein a lighting element formed within the latching mechanism, the power cord coupled to the lighting element and the pump.

7. The pool cleaner of claim 1, comprising:

a housing storing the battery pack;

an activation/deactivation switch formed in the housing; and a first housing connector coupling the power cord to the battery pack.

8. The pool cleaner of claim 7, comprising a second housing connector coupling the battery pack to an auxillary power supply.

9. The pool cleaner of claim 1, comprising a third waterproof connector connected between the battery pack and an auxiliary power supply.

10. The pool cleaner of claim 1, comprising a plurality of wheels coupled to a bottom area of the vacuum head.

11. The pool cleaner of claim 1, comprising bristles coupled to a bottom area of the vacuum head.

12. A pool cleaner for cleaning a swimming pool, comprising:

a vacuum head having an intake nozzle drawing in fluid;

a body chamber being cylindrical in shape and coupled to the intake nozzle and having an intake end and a discharge end, wherein fluid entering the body chamber is filtered;

a pivot mount attached to the intake nozzle, the pivot mount allowing the vacuum head to rotate about the pivot mount, wherein the pivot mount comprises:

a cylindrical member attached to the intake, nozzle; and a spherical member rotatably attached to the cylindrical member, the spherical member in fluid communication with the cylindrical member;

a pump housed within the body chamber drawing fluid from the intake end and expelling the fluid through the discharge end;

a pump cage being cylindrical in shape and having an open top area and positioned within the body chamber, wherein the pump is positioned within the pump cage, the pump cage surrounding sides and an intake end of the pump, a discharge end of the pump pointing towards the open top area and away from the pump cage;

a filter bag placed within the body chamber, the pump cage preventing the filter bag from contacting the pump, the filter bag filtering out particulates from the fluid drawn into the body chamber;

a mesh structure having an open top, bottom and a plurality of side openings, the filter bag being placed within the mesh structure so that the filter bag lines the interior of the mesh structure and the ends of the filter bag cover the exterior of the mesh structure, the mesh structure having a same geometric shape as the body chamber, a diameter of the mesh structure being smaller than a diameter of the body chamber;

a battery pack located remote from the pool cleaner and wearable by a user of the pool cleaner powering the pool cleaner;

a lighting element coupled to the pool cleaner;

a power cord coupled to the battery pack, the power cord being electrically connected to a pump in the body chamber and the lighting element; and a plurality of waterproof connectors, wherein a first waterproof connector is connected between a first end of the power cord and the pump, a second waterproof connector connected between a second end of the power cord and the lighting elements, a third waterproof connector connected to a third end of the power cord and the battery pack and a fourth waterproof connector coupled to the battery pack and an auxiliary power supply.

13. The pool cleaner of claim 12, wherein the lighting element is detachable from the pool cleaner.

14. The pool cleaner of claim 13, wherein the lighting element comprises:

a first lighting element connector attached to the power cord; and a second lighting element connector, wherein the second lighting element connector attaches a second power cord from the lighting element to the pump.

15. The pool cleaner of claim 12, wherein the lighting element is permanently coupled to the body chamber.

16. The pool cleaner of claim 12, comprising:

a dirt tray hingely coupled to a bottom area of the body chamber; and a latching mechanism hingely securing the dirt tray to the bottom of the body chamber;

wherein the lighting element is formed within the latching mechanism.

17. The pool cleaner of claim 12, comprising:

a housing storing the battery pack;

an activation/deactivation switch formed in the housing;

a first housing connector coupling the power cord to the battery pack; and a second housing connector coupling the battery pack to an auxiliary power supply.

18. A pool cleaner for cleaning a swimming pool, comprising:

a vacuum head having an intake nozzle drawing in fluid;

a pivot mount attached to the intake nozzle, the pivot mount allowing the vacuum head to rotate about the pivot mount, wherein the pivot mount comprises:

a cylindrical member attached to the intake nozzle; and a spherical member rotatably attached to the cylindrical member, the spherical member in fluid communication with the cylindrical member;

a pivot cover attached to the pivot mount preventing sideways movement;

a body chamber cylindrical in shape and coupled to the intake nozzle and having an intake end and a discharge end;

a pump housed within the body chamber drawing fluid from the intake end and expelling the fluid through the discharge end;

a pump cage having an open top area and positioned within the body chamber, wherein the pump is positioned within the pump cage, the pump cage surrounding sides and an intake end of the pump, a discharge end of the pump pointing towards the open top area and away from the pump cage;

a filter bag placed within the body chamber filtering out particulates from the fluid drawn into the body chamber, the pump cage preventing the filter bag from contacting the pump housed within the pump cage;

a mesh structure having an open top, bottom and a plurality of side openings, the filter bag being placed within the mesh structure so that the filter bag lines the interior of the mesh structure and the ends of the filter bag cover the exterior of the mesh structure, the mesh structure having a same geometric shape as the body chamber, a diameter of the mesh structure being smaller than a diameter of the body chamber;

a dirt tray hingely coupled to a bottom area of the body chamber;

a latching mechanism hingely securing the dirt tray to the bottom of the body chamber;

a lighting element coupled to the pool cleaner;

a battery pack located remote from the pool cleaner and wearable by a user of the pool cleaner;

a power cord coupling the battery pack to the pump and the lighting element;

a plurality of waterproof connectors, wherein a first waterproof connector is connected between a first end of the power cord and the pump, a second waterproof connector connected between a second end of the power cord and the lighting elements, a third waterproof connector connected to a third end of the power cord and the battery pack and a fourth waterproof connector coupled to the battery pack and an auxiliary power supply;

a housing storing the battery pack;

an activation/deactivation switch formed ire the housing;

a first housing connector coupling the power cord to the battery pack; and a second housing connector coupling the batter pack to an auxiliary power supply.

19. The pool cleaner of claim 18, wherein the lighting element is detachable from the pool cleaner and comprises:

a first lighting element connector attached to the power cord; and a second lighting element connector, wherein the second lighting element connector attaches a second power cord from the lighting element to the pump.

20. The pool cleaner of claim 18, wherein the pump cage is cylindrical in shaped and inserted into the mesh structure, the bag filter positioned between the pump cage and the mesh structure and surrounding the sides.

* * * * *